US005690062A

United States Patent [19]

Yamada

[11] Patent Number: 5,690,062

[45] Date of Patent: Nov. 25, 1997

[54] CYLINDER BLOCK STRUCTURE FOR V-TYPE ENGINE

[75] Inventor: Satoshi Yamada, Toyota, Japan

[73] Assignee: Toyota Jidosha Kabushiki Kaisha, Aichi-ken, Japan

[21] Appl. No.: 723,249

[22] Filed: Sep. 30, 1996

[30] Foreign Application Priority Data

Oct. 6, 1995 [JP] Japan ..... 7-260394

[51] Int. Cl.[6] ..... F01P 11/08

[52] U.S. Cl. ..... 123/41.33; 123/196 AB

[58] Field of Search ..... 123/41.33, 196 AB, 123/54.4

[56] References Cited

U.S. PATENT DOCUMENTS 1,963,172 6/1934 Meyer ..... 123/41.33

FOREIGN PATENT DOCUMENTS 61-43252 3/1986 Japan .
5-86858 4/1993 Japan .

*Primary Examiner*—Noah P. Kamen
*Attorney, Agent, or Firm*—Oliff & Berridge

[57] ABSTRACT

A cylinder block for a V-type engine having a left bank and a right bank. A valley is defined between the two blocks. A stepped section is defined in the valley. The stepped section extends in the longitudinal direction of the valley. A cover plate is fixed to the stepped section to define a coolant passage which coolant flows through. A main oil passage is defined in the cylinder block extending parallel to the coolant passage. The valley includes a projection that projects into the coolant passage. A oil cooling passage is defined in the projection. An opening of the cooling passage is connected with the main oil passage. An opening of a bearing oil passage, which lubricating oil for a crankshaft is supplied through, is also connected with the main oil passage. Rotation of the crankshaft produces pressure fluctuation in the bearing oil passage. The opening of the cooling passage is located on the other side of the main oil passage at a position opposed to the opening of the bearing oil passage. The pressure fluctuation in the bearing oil passage is transmitted to the cooling passage in the projection to produce a flow of lubricating oil therein.

21 Claims, 7 Drawing Sheets

CYLINDER BLOCK STRUCTURE FOR V-TYPE ENGINE

BACKGROUND OF THE INVENTION

1. Field of the Invention

The present invention relates generally to cylinder block structures for V-type engines, and more particularly, to cylinder blocks that are provided with a structure to cool lubricating oil supplied in the cylinder block.

2. Description of the Related Art

A typical engine is lubricated to reduce friction resistance of sliding members inside an engine and to cool the sliding members. Lubricating oil is supplied to various parts of an engine by a lubricating apparatus. To improve the lubrication and cooling functions of the oil, it is necessary to cool the oil, and it is desirable to do this efficiently.

Japanese Unexamined Patent Publication 5-86858 describes a cylinder block structure for a V-type engine. The cylinder block is provided with a structure to cool lubricating oil. The engine includes a cylinder block 81, the cross-sectional front view of which is shown in FIG. 12 and the cross-sectional side view of which is shown in FIG. 13. The cylinder block 81 has a right bank 82*a* and a left bank 82*b*. A valley 83 is defined between the two banks 82*a*, 82*b*. A stepped section 84 is provided in the valley 83. A cover plate 85 is fastened to the stepped section 84 by bolts 86. A coolant passage 87, which coolant flows through, is defined in the space provided between the valley 83 and the cover plate 85. The coolant passage 87 is connected with a coolant inlet 88 that leads to the outlet of a radiator (not shown). The coolant flows into the coolant passage 87 through the inlet 88.

A main oil passage 89 is defined in the cylinder block 81 extending in the axial direction of the coolant passage 87. Lubricating oil that is discharged from an oil pump (not shown) flows through the oil passage 89. The lubricating oil flowing through the oil passage 89 is cooled by the coolant flowing through the coolant passage 87. Thus, oil cooling apparatuses, such as oil coolers, are not required for V-type engines that have the cylinder block 81. Accordingly, the elimination of the cooling apparatus saves space and cost.

However, when the above structure is applied to large-size engines, a large amount of lubricating oil is required to circulate through the cylinder block 81. Therefore, it is necessary to perform efficient heat exchange between the lubricating oil flowing through the oil passage 89 and the coolant flowing through the coolant passage. The above cylinder block 81 is provided with only a single passage, that is, the coolant passage 87 extending in the axial direction of the oil passage 89, to cool the lubricating oil. As a result, the cooling of the lubricating oil flowing through the oil passage 89 may become insufficient.

SUMMARY OF THE INVENTION

Accordingly, it is a primary objective of the present invention to provide a cylinder block structure that increases the cooling efficiency of lubricating oil in a V-type engine provided with a coolant passage that is employed to cool engine lubricating oil flowing through an oil passage. The coolant passage is defined between two banks of the engine and allows coolant to flow therethrough. The oil passage extends longitudinally and parallel to the coolant passage and enables lubricating oil for the engine to flow therethrough.

To achieve the foregoing and other objects and in accordance with the purpose of the present invention, a cylinder block structure for a V-type engine that supports a crankshaft which has a plurality of journals is provided. The structure comprises a plurality of bearings for supporting the journals, a pair of cylinder banks arranged in a V-shape, a valley defined between the banks. The valley extends in the direction of the crankshaft. The structure comprises a coolant passage through which coolant flows to cool the cylinder block and which includes the valley, first oil passage through which lubricating oil for the engine flows. The first oil passage is arranged to extend along the coolant passage in the longitudinal direction thereof. The structure comprises a bearing oil passage for supplying the lubricating oil to one of the journals, wherein the bearing oil passage is formed in one of the bearings, and wherein the bearing oil passage has an exit communicating with an associated one of the journals and an entrance communicating with the first oil passage, and wherein the lubricating oil is introduced to the bearing oil passage via its entrance and is supplied to the journal via its exit. The structure further comprises a projection provided in the valley, wherein said projection includes an oil cooling passage, such that oil flows from the first oil passage to the oil cooling passage; and wherein said oil cooling passage has an opening communicating with the first oil passage, wherein the opening is located at a position opposed to the entrance of the bearing oil passage with respect to the first oil passage, and wherein lubricating oil from the first oil passage is supplied to the oil cooling passage when lubricating oil enters the bearing oil passage from the first oil passage.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

A cylinder block of a V-type gasoline engine according to a first embodiment of the present invention will hereafter be described with reference to FIGS. 1 through 5.

Figure 1:
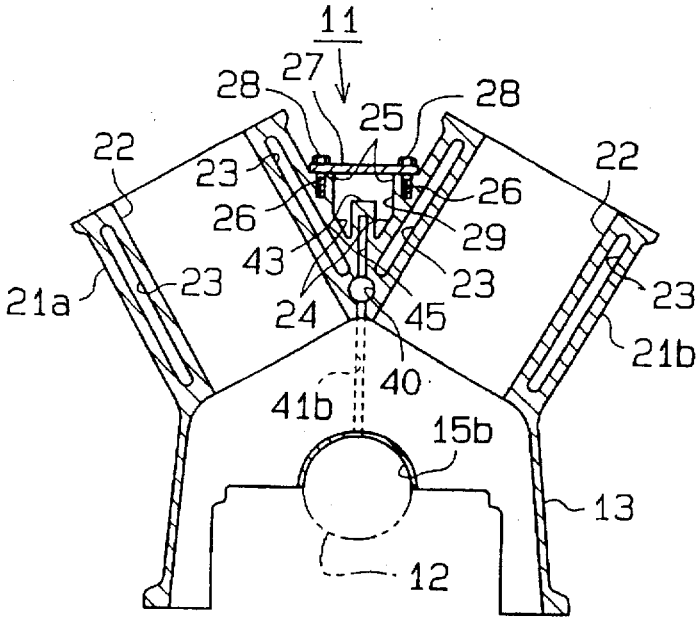
FIG. 1 is a cross-sectional front view showing a cylinder block according to a first embodiment of the present invention.
Figure 2:
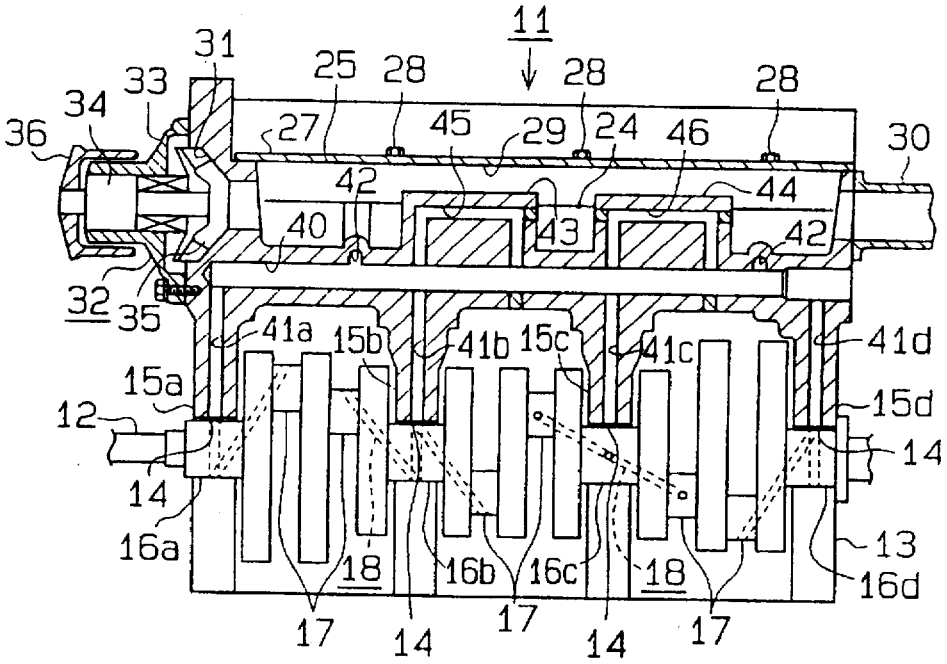
FIG. 2 is a cross-sectional side view showing the cylinder block.

FIG. 1 is a cross-sectional front view showing a cylinder block 11. FIG. 2 is a cross-sectional side view showing the cylinder block 11 and an engine crankshaft 12. The cylinder block 11 is made of an aluminum alloy and includes a crankcase 13. The crankcase 13 encompasses the upper section of the crankshaft 12. A plurality of bearings 15*a*, 15*b*, 15*c*, 15*d* are provided in the crankcase 13. Each bearing 15*a*, 15*b*, 15*c*, 15*d* has an oil hole 14. The crankshaft 12 includes journals 16*a*, 16*b*, 16*c*, 16*d* and crankpins 17. The upper half of the journals 16*a*, 16*b*, 16*c*, 16*d* are fit into the bearings 15*a*, 15*b*, 15*c*, 15*d* while the lower half are fit into bearing caps (not shown). The journals 16*a*, 16*b*, 16*c*, 16*d* are supported such that the crankshaft 12 rotates freely in the crankcase 13.

Figure 5:
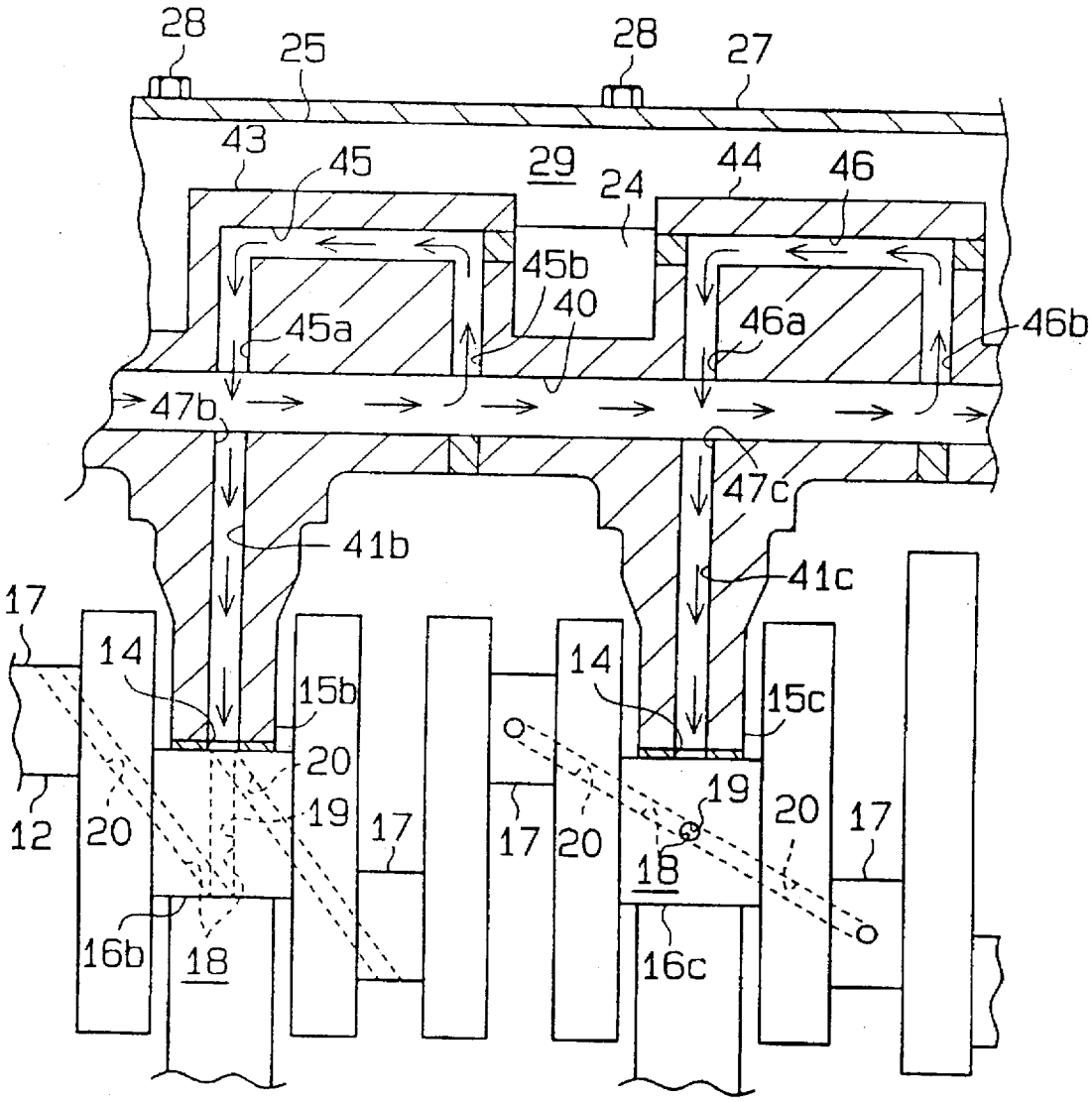
FIG. 5 is a partial enlarged cross-sectional side view showing the vicinity of a projecting section and a oil cooling passage.

The bearings 15*b*, 15*c* and the corresponding journals 16*b*, 16*c*, which are located at the middle section of the crankcase 13, are shown enlarged in FIG. 5. As shown in FIG. 5, oil holes 18 are provided in the journals 16*b*, 16*c* to supply lubricating oil to adjacent crankpins 17. Each oil hole 18 includes an oil inlet conduit 19 and branch conduits 20. The inlet conduit 19 extends radially through the journals 16*b*, 16*c* and opens at the peripheral surface of the journals 16*b*, 16*c*. The branch conduits 20 intersect the inlet conduit 19 and open at the peripheral surface of the adjacent crankpin 17.

The inlet conduits 19 become communicated with the oil holes 14 in the bearings 15*b*, 15*c* during rotation of the crankshaft 12. Lubricating oil is drawn through the oil holes 14 into the inlet conduits 19 from passages 41*b*, 41*c* that are provided to supply oil to the crankshaft 12. The lubricating oil is then conveyed to the journal surfaces of the crankpins 17 through the branch conduits 20 to lubricate the surfaces.

As shown in FIG. 5, the two openings of the inlet conduit 19 in the peripheral surface of the journal 16*b* are radially offset 90 degrees with respect to the two openings of the inlet conduit 19 in the peripheral surface of the journal 16*c*. As shown in FIG. 2, the inlet conduits 19 provided in the journals 16*a*, 16*d*, which are located at the ends of the crankshaft 12, are also each connected to a branch conduit 20 that opens in the peripheral surface of the adjacent crankpin 17.

As shown in FIG. 1, the cylinder block 11 projects upward from the crankcase 13. The cylinder block 11 has a pair of banks 21*a*, 21*b* that define a V-shape and extend from the crankshaft 12. A gasket, cylinder head, head cover, etc. (all not shown) are installed on the upper surfaces of each bank 21*a*, 21*b*.

Figure 3:
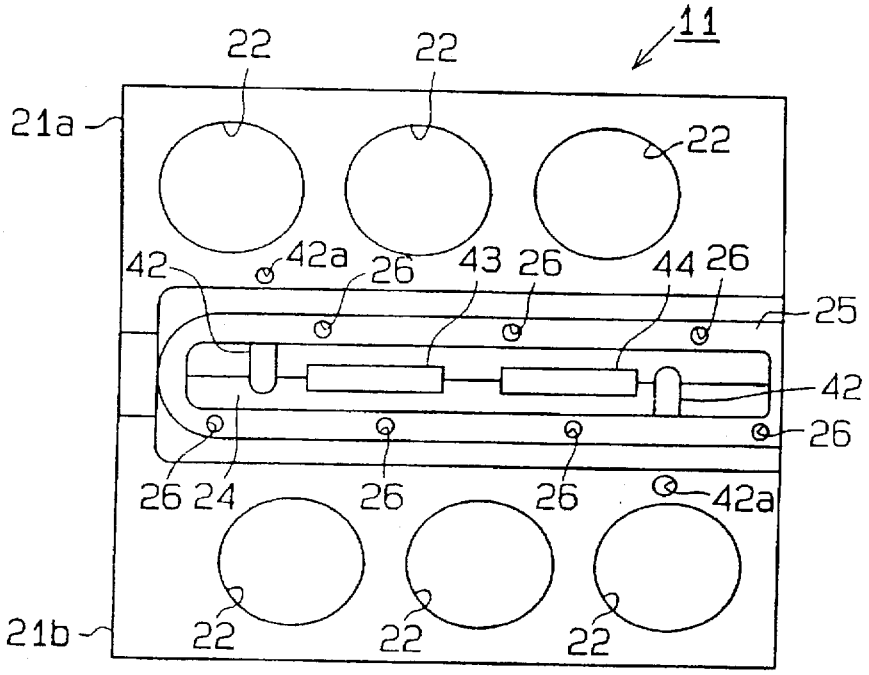
FIG. 3 is a plan view showing the cylinder block.

As shown in FIGS. 1 and 3, each bank 21*a*, 21*b* has a plurality of cylinder bores 22, each of which slidably accommodates a piston (not shown). As shown in FIG. 1, a water jacket 23 surrounds the bores 22 in each bank 21*a*, 21*b*. The banks 21*a*, 21*b* are cooled by coolant circulating through the water jackets 23.

As shown in FIGS. 1 and 2, a V-shaped valley 24 is defined between the banks 21*a*, 21*b*. Stepped sections 25 extend longitudinally in the valley 24. A plurality of threaded holes 26 are formed in the upper surface of the stepped section. A cover plate 27, which is placed on the upper surface of the stepped section 25, is made of an aluminum alloy. The cover plate 27 includes a plurality of through holes (not shown) that correspond to the threaded holes 26. Bolts 28 are inserted into each through hole and fastened to the associated threaded hole 26 to secure the cover plate 27 to the stepped section 25. The cover plate 27 closes and seals the valley 24. A coolant passage 29 is defined in the closed space. Coolant flows through the coolant passage 29. The cover plate 27 is removed from the cylinder block 11 in FIG. 3.

As shown in FIG. 2, the rear side of the cylinder block 11 is connected to a coolant inlet 30 that extends from an outlet of a radiator (not shown). The inlet 30 communicates with the coolant passage 29. The coolant in the radiator is drawn into the coolant passage 29 flowing in a leftward direction of FIG. 2.

As shown in FIG. 2, a pump chamber 31 is provided at the front side of the cylinder block 11 and is communicated with the coolant passage 29. A coolant pump 32 that includes a casing 33, a drive shaft 34, and an impeller 35 is joined to the pump chamber 31. The impeller 35 is coupled to the drive shaft 34 and rotates integrally with the shaft 34. Rotation of the impeller 35 produces centrifugal force to propel the coolant outward. A pulley 36 that rotates integrally with the drive shaft 34 is connected to the crankshaft 12 by a belt (not shown). The rotation of the crankshaft 12 causes rotation of the pulley 36 and drives the water pump 32.

Figure 4:
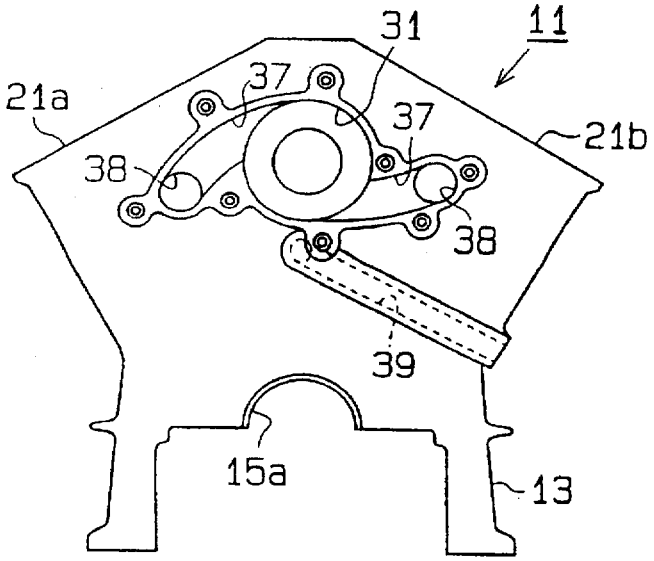
FIG. 4 is a front view showing the cylinder block.

As shown in FIG. 4, a pair of discharge ports 37 communicate the pump chamber 31 to opening 38 of the water jacket 23 in each bank 21*a*, 21*b* at the front side of the cylinder block 11.

A passage that enables circulation of engine lubricating oil in the cylinder block 11 will now be described. As shown in FIG. 4, an oil passage 39 is connected to an oil pump (not shown) at the front side of the cylinder block 11. As shown in FIGS. 1 and 2, a main oil passage 40 extends parallel to the coolant passage 29 in the cylinder block 11.

As shown in FIG. 2, crankshaft oil passages 41*a*, 41*b*, 41*c*, 41*d* extend downward from the main oil passage 40 in the middle of the crankcase 13 at positions corresponding to the bearings 15*a*, 15*b*, 15*c*, 15*d*, respectively. Lubricating oil is supplied to the bearings 15*a*–15*d* through the oil passages 41*a*–41*d*. As shown in FIG. 3, each bank 21*a*, 21*b* has a head oil passage 42 extending upward from the main oil passage 40. Openings 42*a* of the head oil passages 42 are located in the top surface of the banks 21*a*, 21*b*. The lubricating oil in the oil passages of the cylinder head 11 are supplied to journals of a camshaft (not shown) through the openings 42*a*.

As shown in FIGS. 1 to 3, a pair of projections 43, 44 are provided in the valley 24, or the coolant passage 29. As shown in FIG. 2, U-shaped oil cooling passages 45, 46 are defined in the projections 43, 44, respectively. As shown in FIG. 5, first and second openings 45*a*, 45*b* are defined at the ends of the cooling passage 45. First and second openings 46*a*, 46*b* are also defined at the ends of the cooling passage 46. The openings 45*a*, 45*b*, 46*a*, 46*b* are each communicated with the main oil passage 40. More specifically, the first openings 45*a*, 46*a* of the cooling passages 45, 46 are located at positions opposed to openings 47*b*, 47*c* of the crankshaft oil passages 41*b*, 41*c*, respectively. The second opening 45*b* of the cooling passage 45 is located at a position between the crankshaft oil passages 41b, 41c. The second opening 46b of the cooling passage 46 is located at a position between the crankshaft oil passages 41c, 41d. Accordingly, the lubricating oil in the main oil passage 40 enters the cooling passages 45, 46 through the openings 45b, 46b, respectively. The lubricating oil then flows out of the cooling passages 45, 46 through the openings 45a, 46a, respectively, and enters the corresponding crankshaft oil passages 41b, 41c through the openings 47b, 47c.

The operation and effects of the cylinder block 11 having the above structure will now be described.

As shown in FIG. 2, the coolant discharged from the outlet of the radiator is drawn into the coolant passage 29 in the cylinder block 11 through the coolant inlet 30. The coolant in the coolant passage 29 flows to the left, as viewed in FIG. 2, and enters the pump chamber 31. The rotation of the impeller 35 of the pump 32 produces centrifugal force that propels the coolant outward. This sends the coolant to the water jackets 23 via the discharge ports 37 and the openings 38. The coolant circulates through the water jackets 23 to cool the associated banks 21a, 21b and then returns to the radiator.

The lubricating oil discharged from the oil pump is drawn into the main oil passage 40 via the oil passage 39. In the main oil passage 40, the oil flows to the right, as viewed in FIG. 2. The lubricating oil is cooled by the coolant flowing through the coolant passage 29, which is adjacent to the oil passage 40.

The lubricating oil in the main oil passage 40 is drawn into the crankshaft oil passages 41a–41d and the head oil passages 42. The lubricating oil in the crankshaft oil passages 41a, 41b, 41c, 41d of the associated bearings 15a, 15b, 15c, 15d is supplied to the corresponding journals 16a, 16b, 16c, 16d of the crankshaft 12. This lubricates the surface of the journals 16a–16d. The lubricating oil in the head oil passages 42 is supplied to the journals of the camshaft via the openings 42a and the oil passages in the cylinder head 11.

In this embodiment, the journals 16a–16d are provided with the inlet conduits 19. Thus, rotation of the crankshaft 12 enables the inlet conduits 19 to be temporarily communicated with the corresponding oil holes 14 of the bearings 15a–15d. When in a communicated state, the lubricating oil in the main oil passage 40 is drawn into each inlet conduit 19 via the crankshaft oil passages 41a–41d and the oil holes 14. This causes a temporary increase in the flow rate of the lubricating oil in the crankshaft oil passages 41a–41d. It also temporarily decreases the pressure in the oil passages 41a–41d. In other words, the pressure in the oil passages 41a–41d alternates repetitively between a high pressure state and a low pressure state as the crankshaft 12 rotates. The pressure fluctuation in the oil passages 41b, 41c causes pressure waves to be transmitted to the openings 45a, 46a of the associated cooling passages 45, 46. The transmission of the pressure waves causes the lubricating oil in the vicinity of the openings 45a, 46a to move downward toward the openings 47b, 47c of the associated oil passages 41b, 41c.

As a result, the lubricating oil in the cooling passages 45, 46 is conveyed from the openings 45b, 46b toward the openings 45a, 46a, respectively. Thus, as shown by the arrows in FIG. 5, a flow of lubricating oil is produced. This causes the lubricating oil in the main oil passage 40 to be drawn into the cooling passages 45, 46 through the associated openings 45b, 46b. The oil flows through the oil passages 45, 46 and then flows out of the openings 45a, 46a and enters the corresponding oil passages 41b, 41c through the openings 47b, 47c, respectively. In this embodiment, the inlet conduits 19 extend radially through the journals 16b, 16c. Accordingly, the lubricating oil in the cooling passages 45, 46 is moved twice for every single rotation of the crankshaft 12.

As described above, the lubricating oil in the main oil passage 40 is forcibly circulated in the cooling passages 45, 46. In addition, the cooling passages 45, 46 are defined in the projections 43, 44 projecting into the coolant passage 29. This structure improves the efficiency of the heat transfer between the lubricating oil, which flows through the projections 43, 44, and the coolant, which flows through the coolant passage 29. Accordingly, the lubricating oil circulating through the cooling passages 45, 46 is effectively cooled by the coolant in the coolant passage 29. This suppresses an increase in the temperature of the lubricating oil.

In this embodiment, lubricating oil in the main oil passage 40 is forcibly circulated through the cooling passages 45, 46, which have a large cooling efficiency, by utilizing the pressure fluctuation produced in the crankshaft oil passages 41b, 41c. This enables further effective cooling of the lubricating oil in the main oil passage 40. Accordingly, the structure of the cylinder block 11 according to the present invention may be adapted in large-size engines. In this case, regardless of the relatively large amount of circulating lubricating oil, the structure according to the present invention allows sufficient cooling of the oil and suppresses an increase in the temperature of the oil.

In this embodiment, two projections 43, 44 project into the coolant passage 29. The cooling passages 45, 46 are provided in the associated projections 43, 44 to circulate the lubricating oil from the main oil passage 40 therein. By providing a plurality of cooling passages 45, 46, a larger amount of lubricating oil may be simultaneously cooled as compared to the case in which only a single cooling passage is provided. Accordingly, the lubricating oil is cooled effectively.

In this embodiment, the main oil passage 40 extends parallel to the coolant passage 29. This enables the lubricating oil in the main oil passage 40 to be cooled by the coolant in the coolant passage 29. Accordingly, this structure eliminates the necessity for separate cooling apparatuses, such as oil coolers, to cool the lubricating oil. This saves the space and cost of lubricating apparatuses.

In this embodiment, lubricating oil is forcibly circulated through the cooling passages 45, 46 by utilizing the pressure fluctuation produced in the corresponding crankshaft oil passages 41b, 41c. Accordingly, a drive source need not be added to the prior art cylinder block to circulate the lubricating oil. Therefore, the lubricating oil is circulated by a relatively simple structure.

Second through fourth embodiments according to the present invention will hereafter be described. In the following embodiments, the projections and the structure of the passages therein differ from the first embodiment. The other parts are identical to the first embodiment. Thus, the parts differing from the first embodiment will be described below. Parts that are identical to the first embodiment will be denoted with the same numerals.

Figure 6:
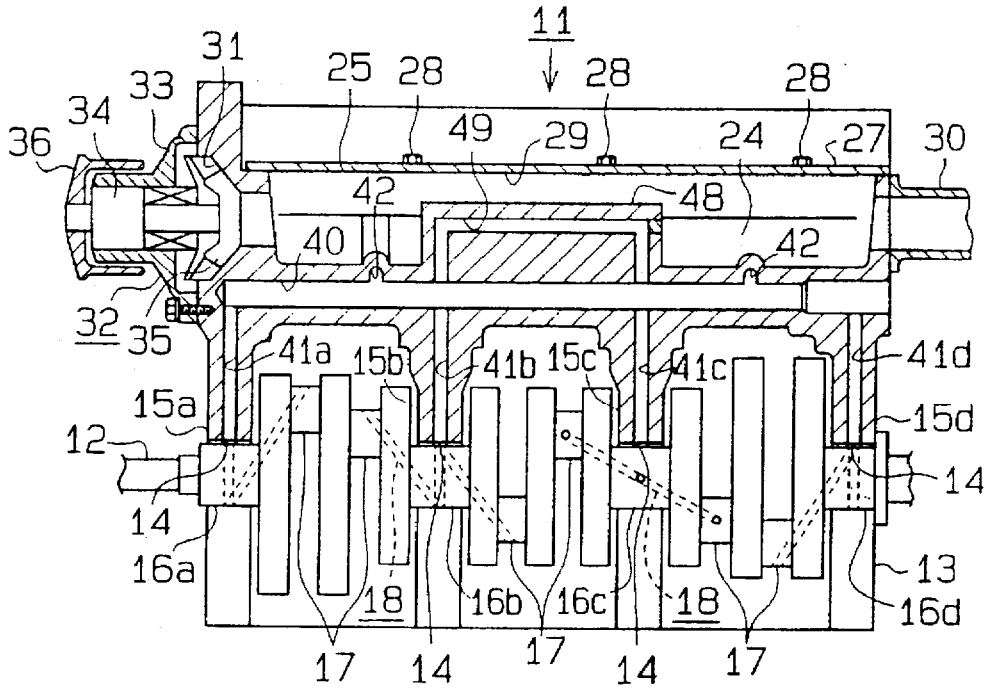
FIG. 6 is a cross-sectional side view showing a cylinder block according to a second embodiment of the present invention.
Figure 7:
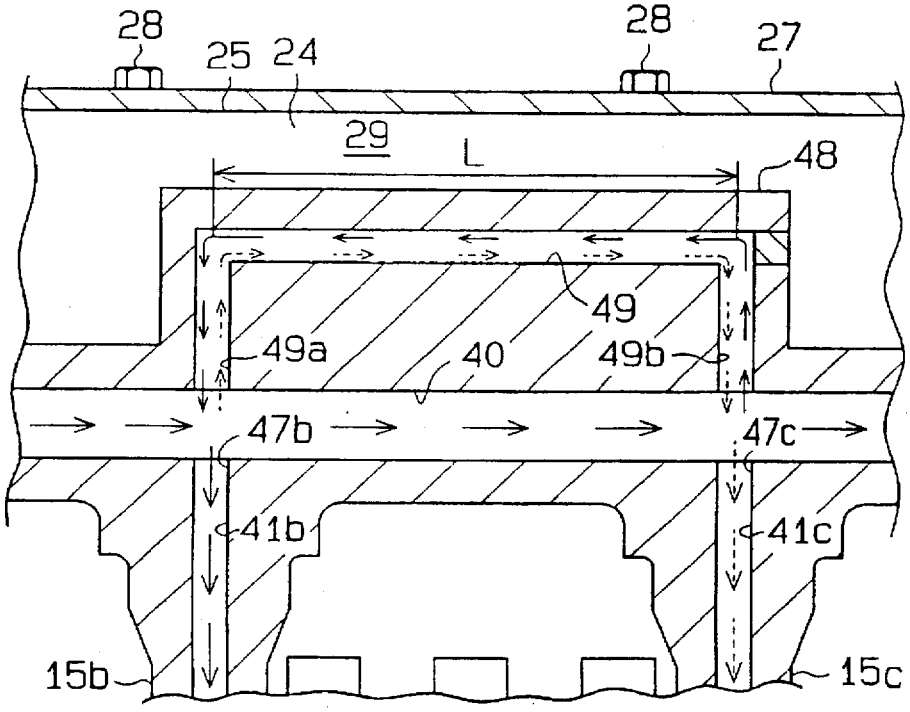
FIG. 7 is a partial enlarged cross-sectional side view showing the vicinity of a projecting section and a oil cooling passage.

The second embodiment will now be described with reference to FIGS. 6 and 7. In this embodiment, a single projection 48 is provided in the coolant passage 29. A U-shaped cooling passage 49 extends through the projection 48. As shown in FIG. 7, the openings 49a, 49b of the cooling passage 49 are connected with the main oil passage 40. The lubricating oil in the oil passage 40 flows into the cooling passage 49 through both openings 49*a*, 49*b*. The openings 49*a*, 49*b* are located at positions opposed to the openings 47*b*, 47*c* of the crankshaft oil passages 41*b*, 41*c*, respectively. The oil passages 41*b*, 41*c* are located at the middle section of the crankcase 13.

In the same manner as the first embodiment, the two openings of the inlet conduit 19 in the peripheral surface of the journal 16*b* are radially offset 90 degrees with respect to the two openings of the inlet conduit 19 in the peripheral surface of the journal 16*c*. Thus, pressure fluctuation in the oil passages 41*b*, 41*c* occurs at different phases of the crankshaft 12.

In other words, when the opening of the inlet conduit 19 that corresponds to the bearing 15*b* is connected with the oil hole 14 of the bearing 15*b*, the opening of the inlet conduit 19 that corresponds to the bearing 15*c* is disconnected from the oil hole 14 of the bearing 15*c*. Contrarily, when the opening of the inlet conduit 19 that corresponds to the bearing 15*b* is disconnected from the oil hole 14 of the bearing 15*b*, the opening of the inlet conduit 19 that corresponds to the bearing 15*c* is connected with the oil hole 14 of the bearing 15*c*. Accordingly, the lubricating oil alternately flows in the two oil passages 41*b*, 41*c*.

The alternately timed flow of the lubricating oil in the two passages 41*b*, 41*c* causes the lubricating oil in the main oil passage 40 to alternately change its flowing direction. That is, when lubricating oil flows through the oil passage 41*b*, shown at the left side of FIG. 7, the pressure decreases in the same passage 41*b* and causes a pressure wave to be transmitted to the left opening 49*a* of the cooling passage 49. This results in the lubricating oil in the vicinity of the opening 49*a* being drawn into the opening 47*b* of the oil passage 41*b*. Accordingly, as shown by the solid-line arrows in FIG. 7, the lubricating oil in the main oil passage 40 is drawn into the cooling passage 49 through the right opening 49*b* and conveyed toward the left opening 49*a* of the same passage 49.

Oppositely, when lubricating oil flows through the oil passage 41*c*, shown at the right side of FIG. 7, the pressure decreases in the same passage 41*c* and causes the lubricating oil in the vicinity of the right opening 49*b* of the cooling passage 49 to be drawn into the opening 47*c* of the oil passage 41*c*. Accordingly, as shown by the dotted-line arrows in FIG. 7, the lubricating oil in the main oil passage 40 is drawn into the cooling passage 49 through the left opening 49*a* and conveyed toward the right opening 49*b* of the same passage 49.

In this embodiment, the alternately timed flow of the lubricating oil in the crankshaft oil passages 41*b*, 41*c* causes the direction of the oil flowing through the main oil passage 40 to be changed alternately. Furthermore, the inlet conduits 19 extend radially through each journal 16*b*, 16*c* in a manner that the phases of the two openings in the journal 16*b*are offset 90 degrees from the two openings in the journal 16*c*. Accordingly, the lubricating oil in the cooling passage 49 is moved twice for every single rotation of the crankshaft 12.

In addition to the advantageous effects obtained in the first embodiment, the following advantageous effects are also obtained in the second embodiment.

The direction of the lubrication oil flowing through the cooling passage 49 is changed alternately by the pressure fluctuation that takes place in the crankshaft oil passages 41*b*, 41*c* during different phases. This cools the lubricating oil in the main oil passage 40 more efficiently and suppresses an increase in the oil temperature.

In this embodiment, the openings 49*a*, 49*b* of the cooling passage 49 are located at positions corresponding to the openings 47*b*, 47*c* of the crankshaft oil passages 41*b*, 41*c*, respectively, on the opposite side of the main oil passage 40. Accordingly, the longitudinal length L of the cooling passage 49 extending through the projection 48 in the coolant passage 29 may be longer than that of the first embodiment. This enables efficient cooling of a larger amount of lubricating oil in comparison with the first embodiment.

Figure 8:
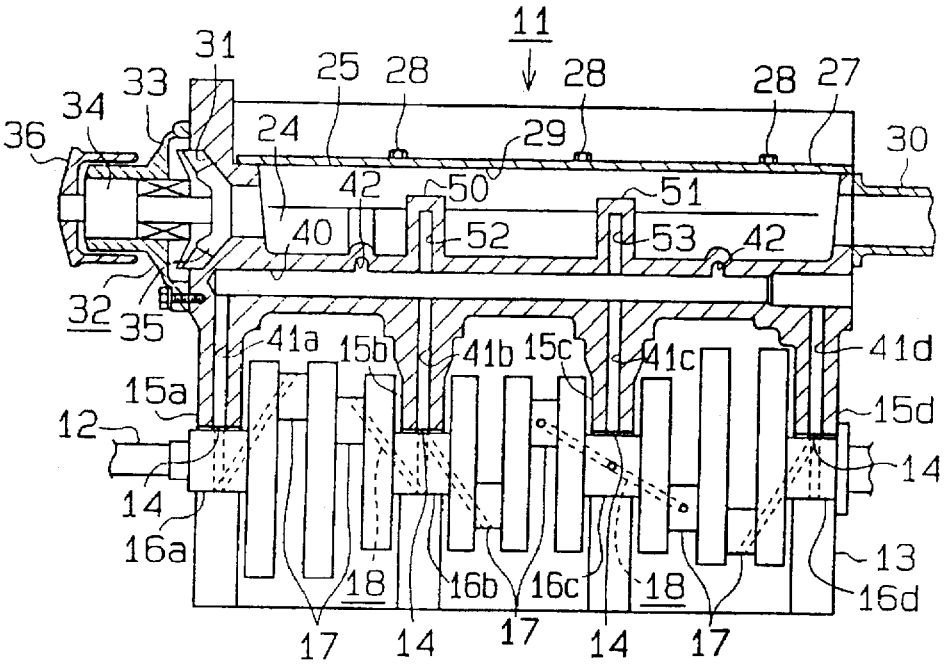
FIG. 8 is a partial cross-sectional side view showing a cylinder block according to a third embodiment of the present invention.
Figure 9:
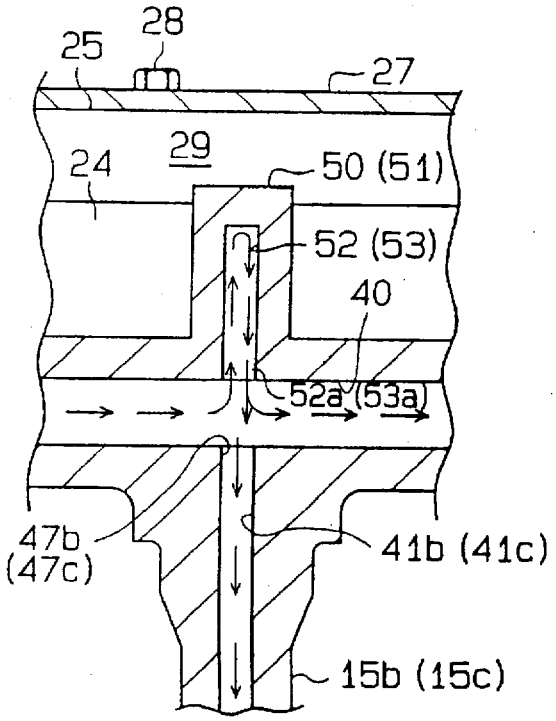
FIG. 9 is a partial enlarged cross-sectional side view showing the vicinity of a projecting section and a oil cooling passage.

The third embodiment will be described with reference to FIGS. 8 and 9. In this embodiment, two projections 50, 51 are provided in the coolant passage 29. The projections 50, 51 are located at positions corresponding to the crankshaft oil passages 41*b*, 41*c*. The projections 50, 51 differ from the first and second embodiments in that a cooling hole 52, 53 is defined in each projection 50, 51, respectively, instead of the cooling passages 45, 46, 49. The cooling hole 52, 53 has a opening 52*a*, 53*a*. The upper end of each hole 52, 53 is closed. As shown in FIG. 8, the lower end of the holes 52, 53 open in the main oil passage 40 and are located at positions corresponding to the openings of the associated oil passages 41*b*, 41*c* on the opposite side of the oil passage 40. The lubricating oil flowing through the main oil passage 40 flows into the cooling holes 52, 53.

In this embodiment, the pressure fluctuation in the oil passages 41*b*, 41*c* produces pressure waves that are transmitted to the openings in the associated cooling holes 52, 53. Accordingly, as shown by the arrows in FIG. 9, the lubricating oil in the main oil passage 40 first flows into the cooling holes 52, 53 and is then drawn into the associated oil passages 41*b*, 41*c* through the openings 47*b*, 47*c*. As the oil flows into the oil passages 41*b*, 41*c*, the lubricating oil in the main oil passage 40 is drawn into the cooling holes 52, 53 again. In other words, the pressure fluctuation produced in the oil passages 41*b*, 41*c* causes the lubricating oil to circulate through the associated cooling holes 52, 53. Hence, the lubricating oil 40 in the main oil passage 40 flows into the cooling holes 52, 53 and is cooled therein by the coolant flowing through the coolant passage 29.

In addition to the advantageous effects obtained in the first embodiment, the following advantageous effects are also obtained in this third embodiment.

The pressure fluctuation in the crankshaft oil passages 41*b*, 41*c* causes the lubricating oil to circulate through the associated cooling holes 52, 53. The cooling holes 52, 53 are respectively defined in the projections 50, 51 that project into the coolant passage 29. This enables the lubricating oil flowing through the main oil passage 40 to be efficiently cooled in the cooling holes 52, 53. As a result, the structure of the projections 50, 51 suppresses an increase in the oil temperature.

The projections 50, 51 of the third embodiment differ from the projections 43, 44, 48 in the first and second embodiments that have the U-Shaped cooling passages 45, 46, 49, respectively, defined therein. That is, the projections 50, 51 are respectively provided with cooling holes 52, 53 that have a closed end and extend straightforward. Hence, the oil cooling structure of the third embodiment is simpler than that of the first and second embodiment.

The fourth embodiment will be described with reference to FIG. 10. In the first embodiment, the projections 43, 44 are provided integrally with the cylinder block 11 with cooling passages 49 defined therein. In this embodiment, a cooling passage 54 which has two openings 54*a*, 54*b* is provided as shown in FIG. 10.

Figure 10:
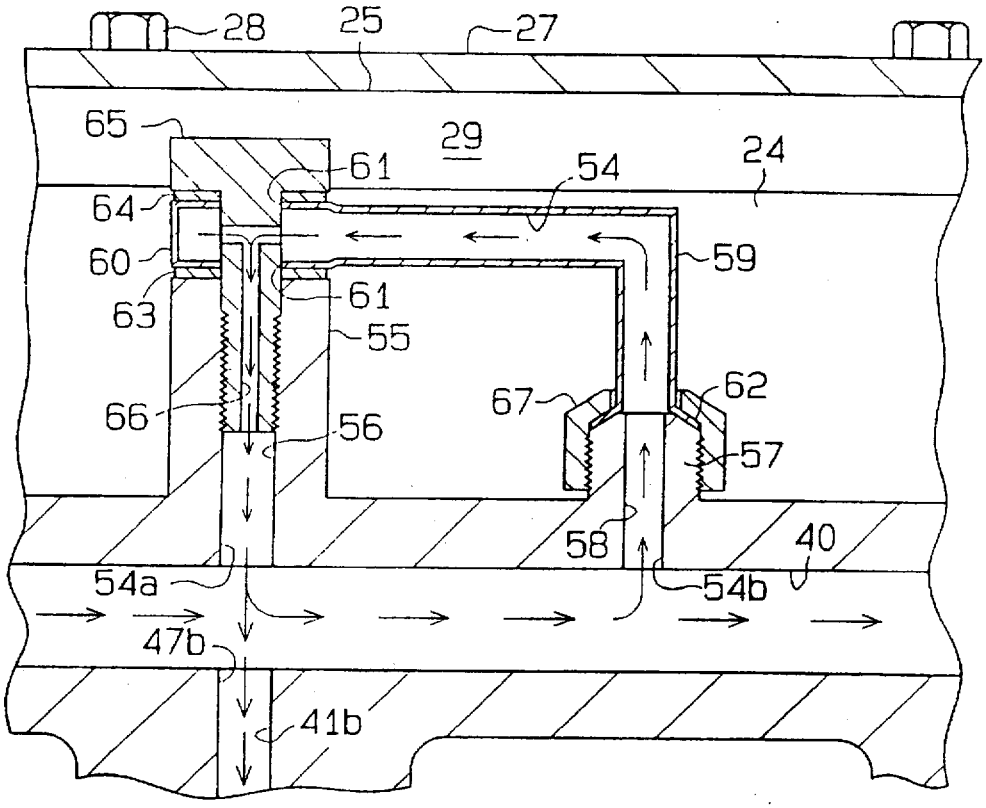
FIG. 10 is a partial enlarged cross-sectional view showing the vicinity of a oil cooling passage according to a fourth embodiment of the present invention.

In other words, a first joint 55, which is shown in FIG. 10, is provided in the cylinder block 11 at positions corresponding to the left openings 45*a*, 46*a* of the respective cooling passages 45, 46, which are shown in FIG. 5. (Only one of the first joints 55 is shown in FIG. 10.) Each first joint 55 projects into the coolant passage 29. An oil hole 56 is defined in each of the joints 55. The lower end of the oil holes 56 are located at positions corresponding to the openings 47*b*, 47*c* of the associated crankshaft oil passages 41*b*, 41*c* on the opposite side of the oil passage 40 while the top ends of the holes 56 open in the coolant passage 29.

A second joint 57, which is shown in FIG. 10, is provided in the cylinder block 11 at positions corresponding to the right openings 45*b*, 46*b* of the respective cooling passages 45, 46, which are shown in FIG. 5. (Only one of the second joints 57 is shown in FIG. 10.) Each second joint 57 projects into the coolant passage 29. An oil hole 58 is defined in each of the second joints 57. In the same manner as the first joints 55, the bottom ends of the oil holes 58 open in the main oil passage 40 while the top ends of the holes 58 open in the coolant passage 29. The upper end of the second joints 57 are formed in an inclined manner.

Each set of oil holes 56, 58 defined in the first and second joints 55, 57, respectively, are connected to each other by a pipe 59. The pipe 59 consists of a cylindrical tube that is made of copper (Cu), which is a material having high thermal conductivity. Each pipe 59 has a closed end and a flat section 60, where the upper and lower inner walls are parallel to each other. Insertion holes 61 are formed through the opposing upper and lower walls in the flat section 60. An enlarged diameter section 62 is provided at the other end of the pipe 59 in a flared manner.

The flat section 60 of the pipe 59 is arranged on the top surface of the first joint 55 with a sealing gasket 63 provided therebetween. Another sealing gasket 64 is arranged on the upper surface of the flat section 60. A bolt 65 is inserted through the insertion holes 61. The bottom section of the bolt 65 is screwed into the oil hole 56 of the first joint 55. This enables the head of the bolt 65 to fasten the flat section 60 to the first joint 55 with the gaskets 63, 64 provided in between. As shown in FIG. 10, a T-shaped hole 66 is defined in the bolt 65. The oil hole 56 in the first joint 55 is connected to the pipe 59 by the T-shaped hole 66.

As shown in FIG. 10, the enlarged diameter section 62 of the pipe 59 is arranged so that it abuts against the inclined surface on the top end of the second joint 57. A flare nut 67, through which the pipe 59 is fit, is screwed onto the second joint 57. This enables the flare nut 67 to fasten the enlarged diameter section 62 to the joint 57.

In this embodiment, the oil hole 56 in the first joint 55, the T-shaped hole 66, the interior of the pipe 59, and the oil hole 58 in the second joint 57 constitute a cooling passage 54. The cooling passage 54 acts in the same manner as the cooling passages 45, 46 in the first embodiment. Accordingly, the advantageous effects obtained in the first embodiment may also be obtained in this embodiment.

In addition, as shown in FIG. 10, a large portion of the cooling passage 54 is constituted by the pipe 59. The pipe 59 is made of copper, the thermal conductivity of which is high, and contacts the coolant flowing through the coolant passage 29. Therefore, this structure significantly increases the efficiency of heat transfer between the coolant flowing through the coolant passage 29 and the lubricating oil flowing through the pipe 59. Accordingly, the lubricating oil may be cooled with more efficiency.

Although only four embodiments of the present invention have been described herein, it should be apparent to those skilled in the art that the present invention may be embodied in many other specific forms without departing from the spirit or scope of the invention. Particularly, it should be understood that the above embodiments may be modified as described below.

In the above embodiments, the oil inlet conduits 19 defined in the crankshaft journals 16*b*, 16*c* are through holes. However, each inlet conduit 19 may be defined as a hole having a closed end.

In the first and second embodiments, the cooling passages 45, 46, 49 defined in the projections 43, 44, 48, respectively, have a U-shaped cross-section. However, these cooling passages 45, 46, 49 are not limited to such cross-sectional shapes and may be arbitrarily shaped.

Figure 11:
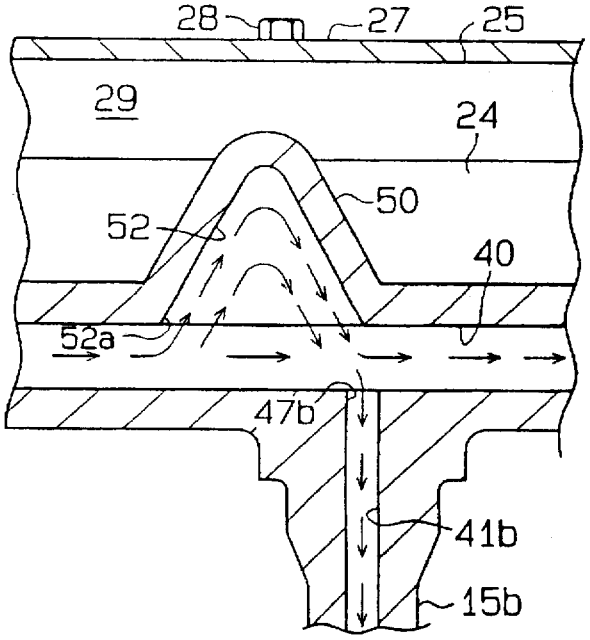
FIG. 11 is an enlarged partial cross-sectional view showing the vicinity of a projecting section according to a fifth embodiment of the present invention.
Figure 12:
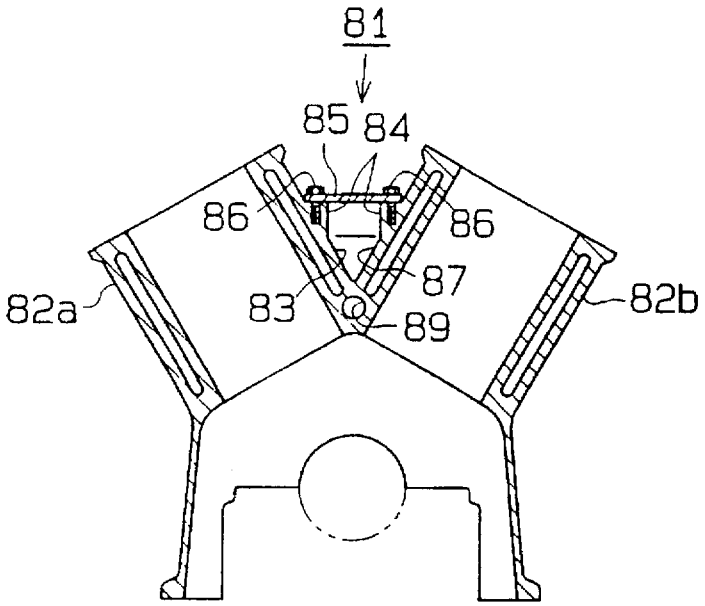
Fig.12 (Prior Art)
FIG. 12 is a cross-sectional front view showing a prior art cylinder block.
Figure 13:
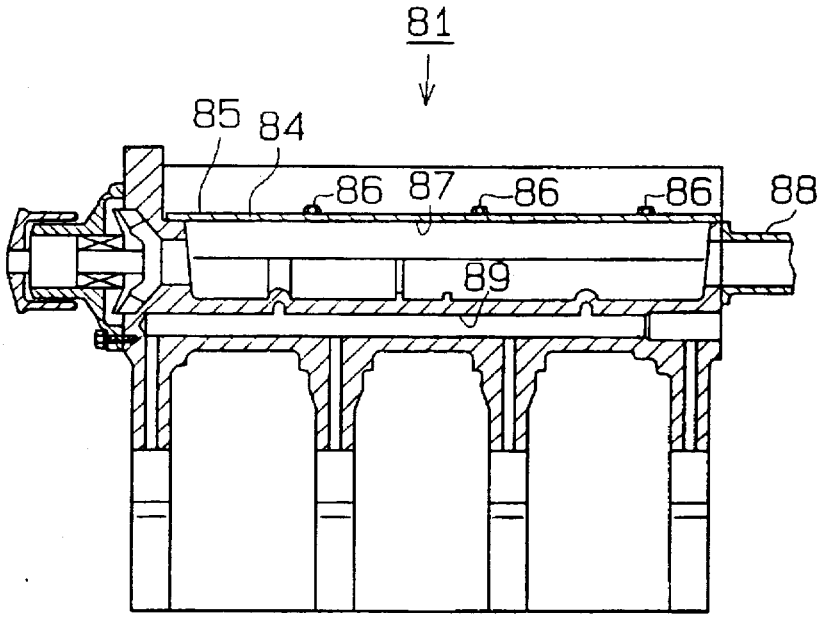
Fig.13 (Prior Art)
FIG. 13 is a cross-sectional side view showing the prior art cylinder block.

In the third embodiment, the cooling holes 52, 53 defined in the projections 43, 44, respectively, may have a triangular cross-sectional shape as shown FIG. 11. As shown in FIG. 11, the cooling hole 52 has a opening communicated with the main oil passage 40. This increases the efficiency of the heat transfer between the coolant flowing through the coolant passage 29 and the lubricating oil flowing through the main oil passage 40. It also allows the oil to flow smoothly through the cooling holes 52, 53.

The pipes 59 in the fourth embodiment may be made having a thin wall. This increases the efficiency of the heat transfer between the coolant flowing through the coolant passage 29 and the lubricating oil flowing through the pipes 59 and thus enables the oil to be cooled further efficiently.

In the fourth embodiment, instead of forming the pipes 59 from copper, the pipes 59 may be made from any material which thermal conductivity is high. Such material includes aluminum (Al).

A main portion of each cooling passage 54, which corresponds to the cooling passages 45, 46 in the first embodiment, is defined by the pipe 50 in the fourth embodiment. In the same manner, the cooling passage 49 in the second embodiment 49 may also be constituted by using the pipe 59. That is, in the second embodiment shown in FIG. 7, the first joint 55 of the fourth embodiment is provided in the cylinder block 11 at a position corresponding to the left opening 49*a* of the cooling passage 49. The second joint 57 is provided at a position corresponding to the right opening 49*b* of the same passage 49. The interiors of the joints 55, 57 are communicated with each other by the pipe 59. Accordingly, the advantageous effects of the second embodiment may also be obtained through this embodiment.

In the above embodiments, the cylinder block 11 and the cover plate 27 are made of an aluminum alloy. However, a cylinder block made of cast iron and a cover plate made of a cast iron or stainless steel may be used instead.

Although the cylinder block structure of the above embodiments are applied to a gasoline engine, these cylinder block structures may also be applied to a diesel engine or other internal combustion engine.

Therefore, the present examples and embodiments are to be considered as illustrative and not restrictive and the invention is not to be limited to the details given herein, but may be modified within the scope of the appended claims.

What is claimed is:

1. A cylinder block structure for a V-type engine that supports a crankshaft, wherein said crankshaft has a plurality of journals, said structure comprising:

a plurality of bearings for supporting said journals;

a pair of cylinder banks arranged in a V-shape;

a valley defined between the banks, wherein the valley extends in the direction of the crankshaft;

a coolant passage through which coolant flows to cool the cylinder block and which includes said valley;

first oil passage through which lubricating oil for the engine flows, said first oil passage being arranged to extend along the coolant passage in the longitudinal direction thereof;

a bearing oil passage for supplying the lubricating oil to one of the journals, wherein said bearing oil passage is formed in one of the bearings, and wherein the bearing oil passage has an exit communicating with an associated one of the journals and an entrance communicating with the first oil passage, and wherein the lubricating oil is introduced to the bearing oil passage via its entrance and is supplied to the journal via its exit;

a projection provided in the valley, wherein said projection includes an oil cooling passage, such that oil flows from the first oil passage to the oil cooling passage; and wherein said oil cooling passage has an opening communicating with the first oil passage; and wherein said opening is located at a position opposed to the entrance of the bearing oil passage with respect to the first oil passage, and wherein lubricating oil from the first oil passage is supplied to the oil cooling passage when lubricating oil enters the bearing oil passage from the first oil passage.

2. The structure as set forth in claim 1, wherein said oil cooling passage has an additional opening communicating with the first oil passage, the additional opening being separate from said opening that is opposed to the entrance of the bearing oil passage and is spaced from the entrance to the bearing oil passage.

3. The structure as set forth in claim 2, wherein said cylinder block has more than one bearing oil passage, and wherein said cylinder block has a plurality of the projections, each located at a position corresponding to one of said plurality of bearings.

4. The structure as set forth in claim 3, wherein each journal has a peripheral surface, and wherein the crankshaft includes an oil passage to carry the lubricating oil therethrough, wherein said crankshaft oil passage has a plurality of openings communicated with the peripheral surface of the journal, and wherein the openings are radially offset with each other in the peripheral surface of the journal.

5. The structure as set forth in claim 4, wherein said oil cooling passage is a U-shaped passage formed in the projection.

6. The structure as set forth in claim 5, wherein said cylinder block is made of an aluminum alloy.

7. The structure as set forth in claim 6 further comprising a cover plate for closing the valley to form a closed space, wherein said coolant passage is defined in said closed space.

8. The structure as set forth in claim 7, wherein the coolant passage has an inlet and an outlet, wherein the coolant passage is supplied with the coolant via the inlet.

9. The structure as set forth in claim 1, wherein said plurality of bearings include a first bearing and a second bearing and wherein the opening that is opposed to said bearing oil passage entrance is associated with the first bearing and wherein an additional bearing oil passage is formed in the second bearing and wherein the oil cooling passage has an additional opening, and wherein the additional opening is located at a position opposed to the entrance of the bearing oil passage associated with the second bearing.

10. The structure as set forth in claim 9, wherein each journal has a peripheral surface, and wherein the crankshaft includes an oil passage to carry the lubricating oil therethrough, and wherein said crankshaft oil passage has a plurality of openings communicated with the peripheral surface of the journal, and wherein the openings are radially offset with each other in the peripheral surface of the journal.

11. The structure as set forth in claim 10, wherein said oil cooling passage is a U-shaped passage formed in the projection.

12. The structure as set forth in claim 11, wherein said cylinder block is made of an aluminum alloy.

13. The structure as set forth in claim 12 further comprising a cover plate for closing the valley to form a closed space, wherein said coolant passage is defined in said closed space.

14. The structure as set forth in claim 1, wherein said plurality of bearings includes a first bearing and a second bearing and wherein the opening that is opposed to the entrance to the bearing oil passage and the projection are associated with the first bearing, and wherein an additional bearing oil passage is formed in the second bearing and wherein an additional projection is formed in association with the second bearing and an additional oil cooling passage is formed in the additional projection and wherein each oil cooling passage has a closed end, and wherein the additional projection has its oil cooling passage located at a position opposed to an entrance of the bearing oil passage associated with the second bearing.

15. The structure as set forth in claim 14, wherein each journal has a peripheral surface, and wherein the crankshaft includes an oil passage to carry the lubricating oil therethrough, and wherein said crankshaft oil passage has a plurality of openings communicated with the peripheral surface of the journal, and wherein the openings are radially offset with each other in the peripheral surface of the journal.

16. The structure as set forth in claim 15, wherein said cylinder block is made of an aluminum alloy.

17. The structure as set forth in claim 16 further comprising a cover plate for closing the valley to form a closed space, wherein said coolant passage is defined in said closed space.

18. The structure as set forth in claim 1, wherein at least a portion of the projection is formed with a pipe that extends into the coolant passage.

19. The structure as set forth in claim 18, wherein said pipe is made of copper.

20. The structure as set forth in claim 1, wherein said oil cooling passage has a triangular cross-sectional shape, and wherein at least a part of the opening communicates with entrance of the bearing oil passage via the first oil passage.

21. A cylinder block structure for a V-type engine that supports a crankshaft comprising:

a pair of cylinder banks arranged in a V-shape;

a valley defined between the banks, wherein the valley extends in the direction of the crankshaft;

a coolant passage through which coolant flows to cool the cylinder block and which includes said valley;

a first oil passage through which lubricating oil for the engine flows, said first oil passage being arranged to extend along the coolant passage in the longitudinal direction thereof;

a projection provided in the valley, wherein said projection includes a second oil passage for carrying lubricating oil, and wherein said second oil passage has at least an opening communicating with the first oil passage to feed the lubricating oil into the second oil passage and receive the lubricating oil from the second oil passage; and oil supplying means for supplying the lubricating oil to said second oil passage via said opening from the first oil passage, wherein the supply of the lubricating oil to the second oil passage occurs in correspondence with periodic pressure pulses that are created by rotation of the crankshaft.

* * * * *